US007431739B2

(12) United States Patent
Penninger

(10) Patent No.: US 7,431,739 B2
(45) Date of Patent: Oct. 7, 2008

(54) BOOSTING THE CLEANING PERFORMANCE OF LAUNDRY DETERGENTS BY POLYMER OF STYRENE/METHYL METHACRYLATE/METHYL POLYETHYLENE GLYCOL

(75) Inventor: Josef Penninger, Hilden (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 11/950,912

(22) Filed: Dec. 5, 2007

(65) Prior Publication Data

US 2008/0090746 A1 Apr. 17, 2008

Related U.S. Application Data

(63) Continuation of application No. PCT/EP2006/004707, filed on May 18, 2006.

(30) Foreign Application Priority Data

Jun. 8, 2005 (DE) ..... 10 2005 026 522

(51) Int. Cl.
*C11D 3/37* (2006.01)
*C11D 13/00* (2006.01)
*D06L 1/00* (2006.01)

(52) U.S. Cl. ..... 8/137; 510/360; 510/361; 510/475; 510/477

(58) Field of Classification Search ..... 510/360, 510/361, 475, 477; 8/137
See application file for complete search history.

(56) References Cited

U.S. PATENT DOCUMENTS

| | | | |
|---|---|---|---|
| 1,985,424 | A | 12/1934 | Piggot |
| 2,016,962 | A | 10/1935 | Flint |
| 2,703,798 | A | 3/1955 | Schwartz |
| 3,547,828 | A | 12/1970 | Mansfield et al. |
| 3,623,956 | A | 11/1971 | Rapidase |
| 3,623,957 | A | 11/1971 | Feldman |
| 3,723,358 | A | 3/1973 | Morgan |
| 3,748,233 | A | 7/1973 | Viccaro |
| 3,893,929 | A | 7/1975 | Basadur |
| 4,000,093 | A | 12/1976 | Nicol et al. |
| 4,081,383 | A | 3/1978 | Warburton et al. |
| 4,116,885 | A | 9/1978 | Derstadt et al. |
| 4,136,038 | A | 1/1979 | Pracht et al. |
| 4,174,305 | A | 11/1979 | Burns et al. |
| 4,203,859 | A | 5/1980 | Kirn et al. |
| 4,240,918 | A | 12/1980 | Lagasse et al. |
| 4,264,738 | A | 4/1981 | Stepanov et al. |
| 4,372,868 | A | 2/1983 | Saran et al. |
| 4,435,307 | A | 3/1984 | Barbesgaard et al. |
| 4,443,355 | A | 4/1984 | Murata et al. |
| 4,585,642 | A | 4/1986 | Rieck |
| 4,590,237 | A | 5/1986 | Wuhrman et al. |
| 4,755,319 | A | 7/1988 | Smolka et al. |
| 4,820,439 | A | 4/1989 | Rieck |
| 4,832,866 | A | 5/1989 | Schulz et al. |
| 4,865,774 | A | 9/1989 | Fabry et al. |
| 5,002,695 | A | 3/1991 | Schulz et al. |
| 5,100,796 | A | 3/1992 | Paridans et al. |
| 5,138,046 | A | 8/1992 | Wuest et al. |
| 5,183,651 | A | 2/1993 | Schimmel et al. |
| 5,236,682 | A | 8/1993 | Schimmel et al. |
| 5,268,156 | A | 12/1993 | Schimmel et al. |
| 5,308,596 | A | 5/1994 | Kotzian |
| 5,356,607 | A | 10/1994 | Just |
| 5,374,716 | A | 12/1994 | Biermann et al. |
| 5,427,936 | A | 6/1995 | Moeller |
| 5,534,167 | A | 7/1996 | Billman |
| 5,541,316 | A | 7/1996 | Engelskirchen et al. |
| 5,576,425 | A | 11/1996 | Hill et al. |
| 5,718,891 | A | 2/1998 | Prat et al. |
| 5,830,956 | A | 11/1998 | Stockhausen et al. |
| 5,854,321 | A | 12/1998 | Krause |
| 6,043,209 | A | 3/2000 | Micciche et al. |
| 6,075,093 | A * | 6/2000 | Rodrigues ..... 525/207 |
| 6,187,738 | B1 | 2/2001 | Micciche et al. |
| 6,221,824 | B1 | 4/2001 | Lietzman et al. |
| 2003/0166484 | A1 | 9/2003 | Kingma et al. |
| 2005/5233147 | | 12/2003 | Poppe et al. |
| 2004/0067862 | A1 | 4/2004 | Speckmann et al. |
| 2004/0110648 | A1 | 6/2004 | Jordan et al. |
| 2005/0148484 | A9 | 7/2005 | Speckmann et al. |

FOREIGN PATENT DOCUMENTS

| | | |
|---|---|---|
| CA | 2299437 | 8/2000 |
| DE | 1940488 | 2/1971 |
| DE | 2044161 | 4/1971 |
| DE | 2101803 | 7/1971 |
| DE | 1617141 | 4/1972 |
| DE | 2121397 | 11/1972 |
| DE | 2253063 | 5/1973 |
| DE | 2200911 | 10/1973 |
| DE | 2412837 | 10/1974 |
| DE | 2655551 | 6/1977 |
| DE | 2846984 | 5/1979 |
| DE | 2857292 | 2/1980 |
| DE | 3117250 | 4/1982 |

(Continued)

OTHER PUBLICATIONS

R. Puchta et al. A New Generation of Softeners Tens. Surf. Det. 30, (1993) p. 186.
M. Brock Neue Entwicklungen auf dem Gebiet der Wäscheweichspüler Tens. Surf. Det. 30, (1993) p. 394.
R. Lagerman et al., Synthesis and Performance of ester Quaternary Biodegradable Softeners. J. Am. Oil. Chem. So9c., 71 (1994) p. 97.
I. Shapiro et al., Environmentally Friendly Ester Quats. Cosm. Toil. 109, (1994) p. 77.

*Primary Examiner*—Brian P Mruk
(74) *Attorney, Agent, or Firm*—John Edward Drach

(57) ABSTRACT

Textiles are washed by a process comprising contacting the textile with a cleaning composition comprising a copolymer comprising styrene, methyl methacrylate and methyl polyethylene glycol.

11 Claims, No Drawings

FOREIGN PATENT DOCUMENTS

| | | |
|---|---|---|
| DE | 3207825 | 9/1982 |
| DE | 3207847 | 9/1982 |
| DE | 3322950 | 1/1984 |
| DE | 3324258 | 1/1984 |
| DE | 3436194 | 4/1986 |
| DE | 255884 | 4/1988 |
| DE | 4221381 | 2/1994 |
| DE | 4308794 | 4/1994 |
| DE | 4300772 | 7/1994 |
| DE | 10233834 | 2/2004 |
| DE | 69530692 | 3/2004 |
| DE | 10221009 | 12/2004 |
| EP | 0006638 | 1/1980 |
| EP | 28865 | 5/1981 |
| EP | 037026 | 10/1981 |
| EP | 0066944 | 12/1982 |
| EP | 0080223 | 6/1983 |
| EP | 0080748 | 6/1983 |
| EP | 0092355 | 10/1983 |
| EP | 117553 | 9/1984 |
| EP | 130064 | 1/1985 |
| EP | 150386 | 8/1985 |
| EP | 0164514 | 12/1985 |
| EP | 0164552 | 12/1985 |
| EP | 167309 | 1/1986 |
| EP | 0185427 | 6/1986 |
| EP | 0204284 | 12/1986 |
| EP | 0213729 | 3/1987 |
| EP | 0213730 | 3/1987 |
| EP | 0214761 | 4/1987 |
| EP | 218272 | 4/1987 |
| EP | 0241984 | 10/1987 |
| EP | 241985 | 10/1987 |
| EP | 253567 | 1/1988 |
| EP | 0258068 | 3/1988 |
| EP | 262588 | 4/1988 |
| EP | 265832 | 5/1988 |
| EP | 269977 | 6/1988 |
| EP | 270974 | 6/1988 |
| EP | 0271312 | 6/1988 |
| EP | 272033 | 6/1988 |
| EP | 273125 | 7/1988 |
| EP | 274907 | 7/1988 |
| EP | 0294753 | 12/1988 |
| EP | 0301298 | 2/1989 |
| EP | 301414 | 2/1989 |
| EP | 0305216 | 3/1989 |
| EP | 309931 | 4/1989 |
| EP | 330641 | 8/1989 |
| EP | 331376 | 9/1989 |
| EP | 0334462 | 9/1989 |
| EP | 339550 | 11/1989 |
| EP | 0341947 | 11/1989 |
| EP | 357280 | 3/1990 |
| EP | 357969 | 3/1990 |
| EP | 362671 | 4/1990 |
| EP | 375102 | 6/1990 |
| EP | 376705 | 7/1990 |
| EP | 378261 | 7/1990 |
| EP | 378262 | 7/1990 |
| EP | 384717 | 8/1990 |
| EP | 385401 | 9/1990 |
| EP | 0425427 | 5/1991 |
| EP | 0425428 | 5/1991 |
| EP | 0436835 | 7/1991 |
| EP | 451921 | 10/1991 |
| EP | 468102 | 1/1992 |
| EP | 0502325 | 9/1992 |
| EP | 511456 | 11/1992 |
| EP | 0548599 | 6/1993 |
| EP | 0566439 | 10/1993 |
| EP | 583536 | 2/1994 |
| EP | 0634481 | 1/1995 |
| EP | 0948591 | 10/1999 |
| FR | 2019434 | 7/1970 |
| GB | 1154730 | 6/1969 |
| GB | 1377092 | 12/1969 |
| GB | 1578930 | 11/1980 |
| GB | 2094826 | 9/1982 |
| GB | 2095275 | 9/1982 |
| GB | 2165856 | 4/1983 |
| JP | 04238809 | 8/1992 |
| JP | 04260610 | 9/1992 |
| WO | WO9010695 | 9/1990 |
| WO | WO9013533 | 11/1990 |
| WO | WO9101295 | 2/1991 |
| WO | WO9102792 | 3/1991 |
| WO | WO9108171 | 6/1991 |
| WO | WO9116422 | 10/1991 |
| WO | WO9206984 | 4/1992 |
| WO | WO9311215 | 6/1993 |
| WO | WO9311215 | 7/1993 |
| WO | WO9316110 | 8/1993 |
| WO | WO9502675 | 1/1995 |
| WO | WO9714804 | 4/1997 |
| WO | WO0050553 | 8/2000 |
| WO | WO0050556 | 8/2000 |
| WO | WO0212425 | 2/2002 |
| WO | WO0212426 | 2/2002 |
| WO | WO0226927 | 4/2002 |

* cited by examiner

BOOSTING THE CLEANING PERFORMANCE OF LAUNDRY DETERGENTS BY POLYMER OF STYRENE/METHYL METHACRYLATE/METHYL POLYETHYLENE GLYCOL

CROSS-REFERENCE TO RELATED APPLICATIONS

This application is a continuation under 35 U.S.C. § 365(c) and 35 U.S.C. § 120 of International Application No. PCT/EP2006/004707, filed May 18, 2006. This application also claims priority under 35 U.S.C. § 119 of German Patent Application No DE 10 2005 026 522.7, filed Jun. 8, 2005. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present patent application relates to boosting the cleaning performance of detergents for washing textiles by incorporating a specific soil-release polymer.

(2) Description of Related Art, Including Information Disclosed Under 37 C.F.R. §§ 1.97 and 1.98

Besides the indispensable ingredients for the washing process such as surfactants and builders, detergents generally comprise further constituents that can be summarized by the term "detergent auxiliaries" and which include different active substances such as the foam regulators, graying inhibitors, bleaching agents, bleach activators and color transfer inhibitors. These types of auxiliaries also include substances that provide soil-releasing properties and which, when present during the wash cycle, support the soil-release capability of the remaining detergent constituents. Analogously, the same is true for cleaning agents for hard surfaces. These types of soil-release substances are often called "soil repellents" due to the fact that they are capable of providing the treated surface, for example of fibers, with soil-repellency. Thus, for example, the soil-repellency of methyl cellulose is known from U.S. Pat. No. 4,136,038. European Patent Application EP 0 213 739 discloses the reduced redeposition when using detergents that comprise a combination of soaps and nonionic surfactant with alkyl hydroxyalkyl celluloses. Treatment agents for textiles which comprise cationic surfactants and nonionic cellulose ethers with HLB values of 3.1 to 3.8 are known from European Patent Application EP 0 213 730. U.S. Pat. No. 4,000,093 discloses detergents that comprise 0.1 wt. % to 3 wt. % alkyl cellulose, hydroxyalkyl cellulose or alkyl hydroxyalkyl cellulose as well as 5 wt. % to 50 wt. % surfactant, wherein the surfactant component consists essentially of $C_{10}$ to $C_{13}$ alkyl sulfate and possesses up to 5 wt. % $C_{14}$ alkyl sulfate and less than 5 wt. % alkyl sulfate with $C_{15}$ and higher alkyl groups. U.S. Pat. No. 4,174,305 discloses detergents that comprise 0.1 wt. % to 3 wt. % alkyl cellulose, hydroxyalkyl cellulose or alkyl hydroxyalkyl cellulose as well as 5 wt. % to 50 wt. % surfactant, wherein the surfactant component consists essentially of $C_{10}$ to $C_{12}$ alkyl sulfate and possesses less than 5 wt. % alkylbenzene sulfonate with $C_{13}$ and higher alkyl groups. European Patent Application EP 0 634 481 relates to a detergent that comprises alkali percarbonate and one or more nonionic cellulose derivatives. Among the latter, solely hydroxyethyl cellulose, hydroxypropyl cellulose and methyl cellulose as well as—in the examples—methyl hydroxyethyl cellulose Tylose® MH50, hydroxypropyl methyl cellulose Methocel® F4M and hydroxybutyl methyl cellulose are explicitly disclosed. European Patent EP 0 271 312 (P&G) relates to soil-release agents, including cellulose alkyl ethers and cellulose hydroxyalkyl ethers (with DS (degrees of substitution) 1.5 to 2.7 and molecular weights of 2,000 to 100,000) such as methyl cellulose and ethyl cellulose, which are intended to be added with peroxyacid bleaching agents in the weight ratio (based on the active oxygen content of the bleaching agent) 10:1 to 1:10. A detergent in liquid or granular form is known from European Patent EP 0 948 591 B1 and provides fabrics and textiles that are washed therewith fabric appearance benefits such as pill/fuzz reduction, protection against color fading, improved abrasion resistance and/or increased softness, and which comprises 1 to 80 wt. % surfactant, 1 to 80 wt. % organic or inorganic builder, 0.1 to 80 wt. % of a hydrophobically modified nonionic cellulose ether with a molecular weight of 10,000 to 2,000,000, wherein the modification consists in the presence of optionally oligomerized (oligomerization degree up to 20) ethyleneoxy or 2-propenyloxy ether units and of $C_{8-24}$ alkyl substituents and the alkyl substituents must be present in amounts of 0.1-5 wt. %, based on the cellulose ether material.

Due to their chemical similarity to polyester fibers, particularly effective soil-release agents for fabrics made of this material are copolyesters that comprise dicarboxylic acid units, alkylene glycol units and polyalkylene glycol units. Soil-release copolyesters of the cited art, as well as their use in detergents, have been known for a long time.

Thus, German Offenlegungsschrift DT 16 17 141, for example, describes a washing process involving the use of polyethylene terephthalate-polyoxyethylene glycol copolymers. German Offenlegungsschrift DT 22 00 91 1 relates to detergents that comprise nonionic surfactant and a mixed polymer of polyoxyethylene glycol and polyethylene terephthalate. Acidic finishing agents for fabrics are cited in German Offenlegungsschrift DT 22 53 063 and comprise a copolymer of a dibasic carboxylic acid and an alkylene or cycloalkylene polyglycol as well as optionally an alkylene or cycloalkylene glycol. Polymers of ethylene terephthalate and polyethylene oxide terephthalate, in which the polyethylene glycol units have a molecular weight of 750 to 5,000, and the molar ratio of ethylene terephthalate to polyethylene oxide terephthalate is 50:50 to 90:10, and their use in detergents are described in German Patent DE 28 57 292. According to German Offenlegungsschrift DE 33 24 258, polymers of ethylene terephthalate and polyethylene oxide terephthalate with a molecular weight 15,000 to 50,000, in which the polyethylene glycol units have a molecular weight 1,000 to 10,000 and the molar ratio of ethylene terephthalate to polyethylene oxide terephthalate is 2:1 to 6:1, can be used in detergents. European Patent EP 066 944 relates to fabric finishing agents, which comprise a copolyester of ethylene glycol, polyethylene glycol, aromatic dicarboxylic acids and sulfonated aromatic dicarboxylic acids in defined molar ratios. Methyl or ethyl group end-capped polyesters, containing ethylene and/or propylene terephthalate units and polyethylene oxide terephthalate units and detergents that comprise such a soil-release polymer are known from European Patent EP 0 185 427. European Patent EP 0 241 984 relates to a polyester which, in addition to oxyethylene groups and terephthalic acid units also comprises substituted ethylene units as well as glycerine units. Polyesters are known from EP 0 241 985 which contain, in addition to oxyethylene groups and terephthalic acid units, 1,2-propylene, 1,2-butylene and/or 3-methoxy-1,2-propylene groups as well as glycerine units, and are end-capped with $C_1$ to $C_4$ alkyl groups. European Patent EP 0 253 567 relates to soil-release polymers with a molecular weight of 900 to 9,000 and made of ethylene terephthalate and polyethylene oxide-terephthalate, in which the polyethylene glycol units have a molecular weight of 300 to 3,000 and the molar ratio of ethylene terephthalate to polyethylene oxide terephthalate is 0.6 to 0.95. Polyesters with polypropylene terephthalate units and polyoxyethylene terephthalate units, at least partially end-capped with $C_{1-4}$ alkyl or acyl groups, are known from European Patent Application EP 0 272 033. European Patent EP 0 274 907 describes soil-release polyesters containing terephthalate end-capped with sulfoethyl groups. According to European Patent Application EP 357 280, soil-release polyesters with terephthalate units, alkylene glycol units and poly-$C_{2-4}$ glycol units are manufactured by sulfonation of the unsaturated end groups. German Patent Application DE 26 55 551 describes the reaction of such polyesters with polymers that contain isocyanate groups, and the use of polymers manufactured in this way against the redeposition of soil when washing synthetic fibers. Detergents are known from German Patent DE 28 46 984 which comprise as the soil-release polymer a reaction product of a polyester with a prepolymer that contains a terminal isocyanate group and manufactured from a diisocyanate and a hydrophilic nonionic macrodiol.

The majority of the polymers known from this extensive prior art have the disadvantage that they show no or only inadequate activity with fabrics that do not consist or at least do not mainly consist of polyester. Today, however, a great deal of textiles consist of cotton or cotton/polyester mixed fabrics, with the result that there exists a need for more effective soil-release polymers for these types of grease soiled textiles.

It has now been surprisingly found that polymers obtained from quite specific monomers have a very good soil-release action—precisely on cotton-containing textiles.

BRIEF SUMMARY OF THE INVENTION

Brief Description of the Several Views of the Drawing(s)

Not Applicable

The present invention pertains to a method of washing a textile comprising contacting the textile with a cleaning composition comprising a copolymer comprising styrene, methyl methacrylate and methyl polyethylene glycol.

DETAILED DESCRIPTION OF THE INVENTION

It is essential that all three cited monomers are comprised in the inventively used polymer. Those polymers are preferred which are obtained from the proportions styrene 5-40 mol %, methyl methacrylate 20-40 mol % and methyl polyethylene glycol 25-65 mol %. Preferred methyl polyethylene glycols are those with a molecular weight in the range 1000 D to 5000 D, particularly, about 2000 D. A methyl polyethylene glycol of this type is commercially available under the name Pluriol® A 2000 E (manufacturer BASF AG). Particularly preferred polymers are block polymers, i.e., those, in which a monomer, particularly styrene, is first polymerized and then subjected to further simultaneous or consecutive polymerization with the other monomers. According to the invention, particularly suitable polymers have a molecular weight of not more than 10000 D, particularly 3000 D to 8000 D. The molecular weight can be determined by means of conventional chromatographic methods with the use of known standards.

In the context of a washing process, the inventive use can proceed in such a way that the polymer is separately added to a wash liquor that contains detergent, or the polymer is incorporated into the wash liquor as a constituent of the detergent. Accordingly, a further subject matter of the invention is a detergent that comprises a polymer described above. In the context of a post-treatment process for washing, the inventive use can proceed such that the polymer is separately added to the rinsing liquor or is incorporated as a constituent of the post-treatment agent, particularly, a softening rinse. In this aspect of the invention, the cited detergent may also comprise the polymer that is to be used according to the invention; however, the detergent can also be free of polymer.

A further subject matter of the invention is a process for washing fabrics, in which a detergent and the above-mentioned soil-release polymer are used. This process can be carried out manually or preferably with the help of a conventional domestic washing machine. Here, the detergent and the polymer that is essential to the invention may be used concurrently or consecutively. Concurrent use can be particularly advantageous when using a detergent that comprises the polymer.

Detergents that comprise the polymer to be used according to the invention can comprise all other conventional components of this type of composition, which do not undergo undesirable interactions with the polymer. The soil-release polymer is preferably incorporated in detergents in quantities of 0.1 wt. % to 2 wt. %, particularly 0.4 wt. % to 1 wt. %.

A further aspect of the invention relates to the enhancement of the cleaning power of detergents when washing fabrics that consist of cotton or that comprise cotton.

It was surprisingly found that the inventively used polymer positively influences the action of certain other components of detergents and cleaning agents and conversely the action of the inventively used polymer is enhanced by certain other detergent components. These effects occur particularly with enzymatic agents, particularly proteases and lipases, with water-insoluble inorganic builders, with water-insoluble inorganic and organic builders, particularly based on oxidized carbohydrates, with bleaching agents based on peroxides, particularly with alkali metal percarbonate, with synthetic anionic surfactants of the sulfate and sulfonate type and with anti-graying inhibitors, for example other, especially anionic cellulose ethers such as carboxymethyl cellulose, which is why the addition of at least one of the cited additional ingredients together with the polymer to be inventively used is preferred.

In a preferred embodiment, such a composition comprises nonionic surfactant, selected from fatty alkyl polyglycosides, fatty alkyl polyalkoxylates, especially ethoxylates and/or propoxylates, fatty acid polyhydroxyamides and/or ethoxylated and/or propoxylated products of fatty alkylamines, vicinal diols, fatty acid alkyl esters and/or fatty acid amides as well as their mixtures, especially in an amount in the range 2 wt. % to 25 wt. %.

A further embodiment of this type of composition includes the presence of synthetic anionic surfactants of the sulfate and/or sulfonate type, especially fatty alkyl sulfate, fatty alkyl ether sulfate, sulfofatty acid ester and/or di-salts of sulfofatty acid, especially in an amount in the range 2 wt. % to 25 wt. % The anionic surfactant is preferably selected from the alkyl or alkenyl sulfates and/or the alkyl or alkenyl ether sulfates, in which the alkyl or alkenyl group has 8 to 22, particularly 12 to 18 carbon atoms.

The possible nonionic surfactants include the alkoxylates, especially the ethoxylates and/or propoxylates of saturated or mono to polyunsaturated linear or branched alcohols containing 10 to 22 carbon atoms, preferably 12 to 18 carbon atoms. The degree of alkoxylation of the alcohols is generally between 1 and 20, preferably between 3 and 10. They can be manufactured by means of the known reaction of the corresponding alcohols with the corresponding alkylene oxides. The derivatives of the fatty alcohols are particularly suitable, although their branched isomers, particularly the oxo alcohols, can also be employed for manufacturing useable alkoxylates. Accordingly, the alkoxylates, especially the ethoxylates, primary alcohols with linear, especially dodecyl, tetradecyl, hexadecyl or octadecyl groups as well as their mixtures can be used. Moreover, corresponding alkoxylation products of alkylamines, vicinal diols and carboxylic acid amides, which in regard to the alkyl moiety correspond to the cited alcohols, can be used. Furthermore, the ethylene oxide and/or propylene oxide insertion products of fatty acid alkyl esters come into consideration, such as those that can be manufactured according to the process cited in the international patent application WO 90/13533, as well as fatty acid polyhydroxyamides, such as those that can be manufactured according to the processes cited in U.S. Pat. No. 1,985,424, U.S. Pat. No. 2,016,962 and U.S. Pat. No. 2,703,798 as well as in International Patent Application WO 92/06984. Suitable alkyl polyglycosides for incorporation into the inventive compositions are compounds of the general formula $(G)_n$-$OR^{12}$, in which $R^{12}$ means an alkyl or alkylene group with 8 to 22 carbon atoms, G a glycose unit and n a number between 1 and 10. These types of compounds and their manufacture are described, for example, in European Patent Applications EP 92 355, EP 301 298, EP 357 969 and EP 362 671 or in U.S. Pat. No. 3,547,828. The glycoside components $(G)_n$ concern oligomers or polymers of naturally occurring aldose or ketose monomers, which particularly include glucose, mannose, fructose, galactose, talose, gulose, altrose, allose, idose, ribose, arabinose, xylose and lyxose. The oligomers consisting of this type of glycosidically linked monomers are characterized not only by the type of sugar comprised in them but also by their number, the "degree of oligomerization." The degree of oligomerization n generally assumes fractional numbers for the analytically determined value; it is between 1 and 10 and for the preferably employed glycosides is below a value of 1.5, particularly between 1.2 and 1.4. Glucose, due to favorable availability, is the preferred monomer building block. The alkyl or alkenyl moiety $R^1$ of the glycoside is also preferably derived from easily available derivatives of renewable raw materials, especially from fatty alcohols, although their branched isomers, particularly the oxo alcohols, can also be employed for manufacturing suitable glycosides. Accordingly, especially the primary alcohols with linear, octyl, decyl, dodecyl, tetradecyl, hexadecyl or octadecyl groups as well as their mixtures can be used. Particularly preferred alkyl glycosides comprise a coco fat alkyl ester group, i.e., mixtures with essentially $R^{12}$=dodecyl and $R^{12}$=tetradecyl.

Nonionic surfactant is comprised in compositions that comprise an inventively used polymer, preferably in amounts of 1 wt. % to 30 wt. %, particularly from 1 wt. % to 25 wt. %, wherein quantities in the higher range are more likely to be encountered in liquid detergents, and granular detergents preferably comprise rather lower quantities of up to 5 wt. %.

The compositions can instead or in addition comprise further surfactants, preferably, synthetic anionic surfactants of the sulfate or sulfonate type, such as, for example, alkylbenzene sulfonates, in amounts of preferably not more than 20 wt. %, particularly 0.1 wt. % to 18 wt. %, each based on the total composition. As particularly suitable synthetic anionic surfactants for use in these types of compositions may be cited the alkyl and/or alkenyl sulfates containing 8 to 22 carbon atoms, which carry an alkali metal, ammonium or alkyl or hydroxyalkyl substituted ammonium ion as the counter ion. The derivatives of fatty alcohols containing especially 12 to 18 carbon atoms and their branched analogs, the oxo alcohols, are preferred. The alkyl and alkenyl sulfates can be manufactured in a known manner by treating the corresponding alcohol component with a conventional sulfating reagent, particularly sulfur trioxide or chlorosulfonic acid, followed by neutralization with alkali metal-, ammonium- or alkyl or hydroxyalkyl substituted ammonium bases. These types of alkyl and/or alkenyl sulfates are preferably comprised in the compositions in amounts of 0.1 wt. % to 15 wt. %, particularly 0.5 wt. % to 10 wt. %.

The suitable surfactants of the sulfate type also include the sulfated alkoxylation products of the cited alcohols, the ether sulfates. Preferably, such ether sulfates comprise 2 to 30, particularly, 4 to 10 ethylene glycol groups per molecule. The suitable anionic surfactants of the sulfonate type include the α-sulfoesters obtained by treating fatty acid esters with sulfur trioxide and subsequent neutralization, especially the sulfonation products derived from fatty acids containing 8 to 22 carbon atoms, preferably 12 to 18 carbon atoms, and linear alcohols containing 1 to 6 carbon atoms, preferably 1 to 4 carbon atoms, as well as those obtained by formal saponification of these above-mentioned sulfofatty acids.

As further optional surfactant-like ingredients, one can consider soaps, wherein saturated fatty acid soaps are suitable, such as the salts of lauric acid, myristic acid, palmitic acid or stearic acid as well as soaps derived from natural fatty acid mixtures, such as coconut oil fatty acid, palm kernel oil fatty acid or tallow fatty acid. Those soap mixtures are particularly preferred that are composed of 50 wt. % to 100 wt. % of saturated $C_{12}$-$C_{18}$ fatty acid soaps and up to 50 wt. % of oleic acid soap. Preferably, soap is comprised in amounts of 0.1 wt. % to 5 wt. %. However, particularly in liquid compositions that comprise a polymer used in accordance with the invention, higher amounts of soap, generally up to 20 wt. %, can also be used.

In a further embodiment, a composition that comprises a polymer used in accordance with the invention comprises water-soluble and/or water-insoluble builders, particularly selected from alkali metal alumosilicate, crystalline alkali metal silicate with a modulus greater than 1, monomeric polycarboxylate, polymeric polycarboxylate and their mixtures, especially in amounts in the range of 2.5 wt. % to 60 wt. %.

A composition that comprises a polymer used in accordance with the invention preferably comprises 20 wt. % to 55 wt. % of water-soluble and/or water-insoluble, organic and/or inorganic builders. The water-soluble organic builders particularly include those from the class of the polycarboxylic acids, particularly, citric acid and sugar acids, as well as the polymeric (poly)carboxylic acids, particularly, the polycarboxylates of International Patent Application WO 93/161 10, which can be obtained by oxidation of polysaccharides, polymeric acrylic acid, methacrylic acid, maleic acid and mixed polymers thereof, which can also comprise small amounts of copolymerized polymerizable substances that are free of carboxylic acid functionality. The relative molecular weight of the homopolymers of unsaturated carboxylic acids lies generally between 5,000 and 200,00, that of the copolymers between 2,000 and 200,000, preferably 50,000 to 120,000, based on the free acid. A particularly preferred acrylic acid-maleic acid copolymer has a relative molecular weight of 50,000 to 100,000. Suitable, yet less preferred compounds of this class are copolymers of acrylic acid or methacrylic acid with vinyl ethers, such as vinyl methyl ethers, vinyl esters, ethylene, propylene and styrene, in which the content of the acid is at least 50 wt. %. Terpolymers, which comprise two unsaturated acids and/or their salts as monomers as well as vinyl alcohol and/or an esterified vinyl alcohol or a carbohydrate as the third monomer, can also be used as water-soluble organic builders. The first acid monomer or its salt is derived from a monoethylenically unsaturated $C_3$-$C_8$ carboxylic acid and preferably from a $C_3$-$C_4$ monocarboxylic acid, particularly from (meth)acrylic acid. The second acid monomer or its salt can be a derivative of a $C_4$-$C_8$ dicarboxylic acid, maleic acid being particularly preferred. In this case the third monomer unit is formed from vinyl alcohol and/or preferably an esterified vinyl alcohol. In particular, vinyl alcohol derivatives are preferred which represent an ester of short chain carboxylic acids, for example $C_1$-$C_4$ carboxylic acids with vinyl alcohol. Preferred terpolymers comprise 60 wt. % to 95 wt. %, particularly, 70 wt. % to 90 wt. % (meth)acrylic acid or (meth)acrylate, particularly preferably, acrylic acid or acrylate, and maleic acid or maleate as well as 5 wt. % to 40 wt. %, preferably, 10 wt.-% to 30 wt. % vinyl alcohol and/or vinyl acetate. Terpolymers are quite particularly preferred, in which the weight ratio (meth)acrylic acid or (meth)acrylate to maleic acid or maleate is between 1:1 and 4:1, preferably, between 2:1 and 3:1 and particularly, 2:1 and 2.5:1. Here, both the quantities and the weight ratios are based on the acids. The second acid monomer or its salt can also be a derivative of an allyl sulfonic acid, which is substituted in the 2-position with an alkyl group, preferably a $C_1$-$C_4$ alkyl group, or an aromatic group that is preferably derived from benzene or benzene derivatives. Preferred terpolymers comprise 40 wt. % to 60 wt. %, particularly, 45 wt. % to 55 wt. % (meth)acrylic acid or (meth)acrylate, particularly preferably, acrylic acid or acrylate, 10 wt. % to 30 wt. %, preferably, 15 wt. % to 25 wt. % methallyl sulfonic acid or methallyl sulfonate and as the third monomer 15 wt. % to 40 wt.-%, preferably, 20 wt. % to 40 wt. % of a carbohydrate. This carbohydrate can, for example, be a mono, di, oligo or polysaccharide, mono, di or oligosaccharides being preferred, saccharose being particularly preferred. Adding the third monomer presumably creates intended weak points in the polymer, which are responsible for the good biological degradation of the polymer. These terpolymers can be manufactured, in particular, according to processes that are described in German Patent DE 42 21 381 and German Patent Application DE 43 00 772, and generally have a relative molecular weight between 1,000 and 200,000, preferably, between 200 and 50,000 and especially, between 3,000 and 10,000. They can be added, especially for the manufacture of liquid compositions, in the form of aqueous solutions, preferably, in the form of 30 to 50 weight percent aqueous solutions. In general, all the cited polycarboxylic acids are added in the form of their water-soluble salts, particularly their alkali metal salts.

Such organic builders are preferably comprised in amounts of up to 40 wt. %, particularly, up to 25 wt. % and particularly preferably, from 1 wt. % to 5 wt. %. Amounts close to the cited upper limit are preferably incorporated in pasty or liquid, particularly aqueous compositions.

In particular, crystalline or amorphous alkali metal alumosilicates in amounts of up to 50 wt. %, preferably not more than 40 wt. % and in liquid agents not more than 1 wt. % to 5 wt. % are added as the water-insoluble, water-dispersible inorganic builders. Among these, the detergent-quality crystalline sodium alumosilicates, particularly, zeolite NaA and optionally, NaX, are preferred. Amounts close to the cited upper limit are preferably incorporated in solid, particulate compositions. Suitable alumosilicates particularly exhibit no particles with a particle size above 30 μm and preferably consist of at least 80 wt. % of particles smaller than 10 μm. Their calcium binding capacity, which can be determined according to the indications of German Patent DE 24 12 837, lies in the range 100 to 200 mg CaO per gram. Suitable substitutes or partial substitutes for the cited alumosilicate are crystalline alkali metal silicates that can be alone or present in a mixture with amorphous silicates. The alkali metal silicates that can be used as builders in the inventive compositions preferably have a molar ratio of alkali metal oxide to $SiO_2$ below 0.95, particularly, 1:1.1 to 1:12, and can be amorphous or crystalline. Preferred alkali metal silicates are the sodium silicates, particularly, the amorphous sodium silicates, with a molar ratio $Na_2O$: $SiO_2$ of 1:2 to 1:2.8. Those with a molar ratio $Na_2O$: $SiO_2$ of 1:1.9 to 1:2.8 can be manufactured according to the process of European Patent Application EP 0 425 427. In the context of manufacturing, they are preferably added as solids and not in the form of a solution. Crystalline silicates that can be present alone or in a mixture with amorphous silicates are preferably crystalline, layered silicates corresponding to the general formula $Na_2Si_xO_{2x+1}yH_2O$, wherein x, the module is a number from 1.9 to 4 and y is a number from 0 to 20, preferred values for x being 2, 3 or 4. Crystalline layered silicates which correspond to this general formula are described, for example, in European Patent Application EP 0 164 514. Preferred crystalline layered silicates are those in which x assumes the values 2 or 3 in the cited general formula. Both β- and δ-sodium disilicates ($Na_2Si_2O_5yH_2O$) are particularly preferred, wherein β-sodium disilicate can be obtained, for example, from the process described in International Patent Application WO 91/08171. δ-Sodium silicates with a module between 1.9 and 3.2 can be manufactured according to Japanese Patent Applications JP 04/238 809 or JP 04/260 610. Practically anhydrous crystalline alkali metal silicates of the above-mentioned general formula, in which x is a number from 1.9 to 2.1 can also be manufactured from amorphous alkali metal silicates, as described in European Patent Applications EP 0 548 599, EP 0 502 325 and EP 0 425 428, and can be used in compositions that comprise an inventively used combination. In a further preferred embodiment of the composition, a crystalline sodium layered silicate with a module of 2 to 3 is added, as can be manufactured from sand and soda according to European Patent Application EP 0 436 835. In a further preferred embodiment of the detergents or cleaning agents that comprise a polymer to be used in accordance with the invention, crystalline sodium silicates with a module of 1.9 to 3.5 are added, as manufactured from the processes of European Patents EP 0 164 552 and/or EP 0 294 753. Their content of alkali metal silicates is preferably in the range 1 wt. % to 50 wt. % and particularly 5 wt. % to 35 wt. %, based on the anhydrous active substance. For the case that alkali metal alumosilicate, particularly zeolite, is also present as an additional builder, then the content of alkali metal silicate is preferably in the range 1 wt. % to 15 wt. % and particularly 2 wt. % to 8 wt. %, based on the anhydrous active substance. The weight ratio of alumosilicate to silicate, each based on anhydrous active substance, is then preferably 4:1 to 10:1. In agents that comprise both amorphous and crystalline alkali metal silicates, the weight ratio of amorphous alkali metal silicate to crystalline alkali metal silicate is preferably 1:2 to 2:1 and particularly 1:1 to 2:1.

In addition to the cited inorganic builders, further water-soluble or water-insoluble inorganic substances can be incorporated into the compositions that comprise a polymer to be used in accordance with the invention. In this context, the alkali metal carbonates, alkali metal hydrogen carbonates and alkali metal sulfates as well as their mixtures are suitable. This type of additional inorganic material can be present in amounts of up to 70 wt. %.

In addition, the compositions can comprise further conventional ingredients of detergents and cleaning agents. These optional ingredients particularly include enzymes, enzyme stabilizers, bleaching agents, bleach activators, complexants for heavy metals, for example, amino polycarboxylic acids, amino hydroxypolycarboxylic acids, polyphosphonic acids and/or amino polyphosphonic acids, color fixatives, color transfer inhibitors, for example, polyvinyl pyrrolidone or polyvinyl pyridine-N-oxide, foam inhibitors, for example, organopolysiloxanes or paraffins, solvents, and optical brighteners, for example, stilbene sulfonic acid derivatives. Preferably, the compositions that comprise a combination used in accordance with the invention comprise up to 1 wt. %, particularly, 0.01 wt. % to 0.5 wt. % optical brightener, particularly, compounds from the class of the substituted 4,4'-bis-(2,4,6-triamino-s-triazinyl)-stilbene-2,2'-disulfonic acids, up to 5 wt. %, particularly, 0.1 wt. % 2 wt. % complexants for heavy metals, particularly, aminoalkylene phosphonic acids and their salts, up to 3 wt. %, particularly, 0.5 wt. % to 2 wt. % graying inhibitors and up to 2 wt. %, particularly, 0.1 wt. % to 1 wt. % foam inhibitors, wherein the cited weight fractions are each based on the total composition.

Solvents that are especially added to liquid compositions are, besides water, preferably those that are miscible with water. They include the lower alcohols, for example, ethanol, propanol, iso-propanol, and the isomeric butanols, glycerine, lower glycols, for example, ethylene and propylene glycol, and the ethers that can be derived from the cited classes of compounds. The ingredients of the combination used in accordance with the invention are generally dissolved in such liquid combinations or are present in the form of a suspension.

Enzymes that are optionally present are preferably selected from the group that includes protease, amylase, lipase, cellulase, hemicellulases, oxidase, peroxidase or their mixtures. Protease isolated from microorganisms, such as bacteria and fungi, are considered first and foremost. They can be isolated in a known manner by means of fermentation processes from suitable microorganisms as described in German Offenlegungsschriften DE 19 40 488, DE 20 44 161, DE 21 01 803 and DE 21 21 397, U.S. Pat. No. 3,623,957 and U.S. Pat. No. 4,264,738, European Patent Application EP 006 638 as well as International Patent Application WO 91/02792. Proteases are commercially available, for example, under the trade names BLAP®, Savinase®, Esperase®, Maxatase®, Optimase®, Alcalase®, Durazym® or Maxapem®. A suitable lipase can be isolated from *Humicola lanuginose*, as described, for example, in European Patent Applications EP 258 068, EP 305 216 and EP 341 947, from *Bacillus* types, such as described, for example, in International Patent Application WO 91/16422 or European Patent Application EP 384 717, from *Pseudomonas* types, as described, for example, in European Patent Applications EP 468 102, EP 385 401, EP 375 102, EP 334 462, EP 331 376, EP 330 641, EP 214 761, EP 218 272 or EP 204 284 or International Patent Application WO 90/10695, from *Fusarium* types, as described, for example, in European Patent Application EP 130 064, from *Rhizopus* types, as described, for example, in European Patent Application EP 117 553, or from *Aspergillus* types, as described, for example, in European Patent Application EP 167 309. Suitable lipases are commercially available, for example, under the trade names Lipolase®, Lipozym®, Lipomax®, Amano®-Lipase, Toyo-Jozo®-Lipase, Meito®-Lipase and Diosynth®-Lipase. Suitable amylases are commercially available, for example, under the trade names Maxamyl®, Termamyl®, Duramyl® and Purafect® OxAm. Suitable cellulase can be an isolated enzyme from bacteria or fungi and exhibits a pH optimum preferably in the weakly acidic to weakly alkaline region of 6 to 9.5. Such cellulases are known, for example from German Offenlegungsschriften DE 31 17 250, DE 32 07 825, DE 32 07 847, DE 33 22 950 or European Patent Applications EP 265 832, EP 269 977, EP 270 974, EP 273 125 as well as EP 339 550 and International Patent Applications WO 95/02675 and WO 97/14804, and are commercially available under the trade names Celluzyme®, Carezyme® and Ecostone®.

The conventional enzyme stabilizers that are optionally present, particularly in liquid compositions, include amino alcohols, for example, mono-, di-, triethanolamine and mono-, di-, tripropanolamine and their mixtures, lower carboxylic acids, such as, for example, those known from European Patent Applications EP 376 705 and EP 378 261, boric acid or alkali metal borates, boric acid carboxylic acid combinations, such as, for example, those known from European Patent Application EP 451 921, boric acid esters, such as, for example, those known from International Patent Application WO 93/1 1215 or European Patent Application EP 511 456, boronic acid derivatives, such as, for example, those known from European Patent Application EP 583 536, calcium salts, for example, the Ca formic acid combination known, for example, from European Patent EP 28 865, magnesium salts, such as, for example, those known from European Patent Application EP 378 262, and/or sulfur-containing reducing agents, such as, for example, those known from European Patent Applications EP 080 748 or EP 080 223.

The suitable foam inhibitors include long chain soaps, especially behenic soap, fatty acid amides, paraffins, waxes, microcrystalline waxes, organopolysiloxanes and their mixtures, which can, moreover, comprise microfine, optionally silanized or otherwise hydrophobized silica. For use in particulate compositions, these types of foam inhibitors are preferably bound to granular, water-soluble carriers, as, for example, are described in German Offenlegungsschrift DE 34 36 194, European Patent Applications EP 262 588, EP 301 414, EP 309 931 or European Patent EP 150 386.

A further embodiment of a composition of this type, which comprises a polymer used in accordance with the invention, comprises bleaching agent based on peroxide, particularly in amounts in the range 5 wt. % to 70 wt. %, as well as optional bleach activators, particularly in amounts in the range 2 wt. % to 10 wt. %. These possible bleaching agents are peroxy compounds generally used in detergents, such as hydrogen peroxide, perborate that can be present as the tetra- or monohydrate, percarbonate, perpyrophosphate and persilicate, which are generally present as the alkali metal salts, particularly as the sodium salts. Such bleaching agents are preferably present in detergents that comprise a polymer used in accordance with the invention, in amounts up to 25 wt. %, particularly, up to 15 wt. % and particularly preferably, from 5 wt. % to 15 wt. %, each based on the total composition, percarbonate being particularly incorporated. The optionally present components of the bleach activators, include the customarily used N-or O-acyl compounds, for example, polyacylated alkylenediamines, particularly tetraacetyl ethylenediamine, acylated glycolurils, in particular tetraacetyl glycoluril, N-acylated hydantoins, hydrazides, triazoles, urazoles, diketopiperazines, sulfuryl amides and cyanurates, also carboxylic acid anhydrides, particularly phthalic anhydride, carboxylic acid esters, particularly sodium isononanoyl phenol sulfonate, and acylated sugar derivatives, in particular pentaacetylglucose, as well as cationic nitrile derivatives such as trimethyl ammonium acetonitrile salts. In order to prevent the bleach activators interacting with the peroxy compounds during storage, they can be encapsulated according to known methods or granulated, wherein tetraacetyl ethylenediamine, granulated with the help of carboxymethyl cellulose to an average particle size of 0.01 mm to 0.8 mm, as can be manufactured for example according to the process described in European patent EP 37 026, granulated 1,5-diacetyl-2,4-dioxohexahydro-1,3,5-triazine, as can be manufactured according to the process described in German Patent DD 255 884, and/or trialkyl ammonium acetonitrile made up in particulate form according to the processes described in International Patent Applications WO 00/50553, WO 00/50556, WO 02/12425, WO 02/12426 or WO 02/26927 is particularly preferred. The detergents comprise these types of bleach activators in amounts of up to 8 wt. %, particularly 2 wt. % to 6 wt. %, each based on the total composition.

It is also possible to use the cited polymer together with a polyester-active soil-release polymer of dicarboxylic acid and diol that can also be a polymeric diol or a mixture of monomeric and polymeric diol, in order to enhance the cleaning power of detergents when washing fabrics.

The active polyester soil-release polymers that can be additionally incorporated in the inventively essential polymer include copolyesters of dicarboxylic acids, for example, adipic acid, phthalic acid or terephthalic acid, diols, for example, ethylene glycol or propylene glycol, and polydiols, for example, polyethylene glycol or polypropylene glycol. The preferred soil-release polyesters employed include such compounds that are formally obtained by the esterification of two monomeric moieties, wherein the first monomer is a dicarboxylic acid HOOC-Ph-COOH and the second monomer is a diol $HO—(CHR^{11}—)_a)_bOH$ that can also be present as the polymeric diol $H—(O—(CHR^{11}—)_a)_bOH$. Here, Ph means an o-, m- or p-phenylene group that can carry 1 to 4 substituents selected from alkyl groups with 1 to 22 carbon atoms, sulfonic acid groups, carboxyl groups and their mixtures, $R^{11}$ is hydrogen, an alkyl group with 1 to 22 carbon atoms and their mixtures, a is a number from 2 to 6 and b is a number from 1 to 300. Preferably, both monomer diol units $—O—(CHR^{11}—)_aO—$ and also polymeric diol units $—(O—(CHR^{11}—)_a)_bO—$ are present in the resulting polyesters. The molar ratio of monomeric diol units to polymeric diol units preferably ranges from 100:1 to 1:100, particularly, 10:1 to 1:10. The degree of polymerization b of the polymeric diol units is preferably in the range 4 to 200, particularly, 12 to 140. The molecular weight, or the average molecular weight, or the maximum of the molecular weight distribution of preferred soil-release polyesters is in the range 250 to 100,000, particularly, 500 to 50,000. The acid based on the Ph group is preferably selected from terephthalic acid, isophthalic acid, phthalic acid, trimellitic acid, mellitic acid, the isomers of sulfo phthalic acid, sulfo isophthalic acid and sulfo terephthalic acid and their mixtures. As long as their acid groups are not part of the ester linkages in the polymer, then they are preferably present in salt form, particularly, as the alkali metal or ammonium salt. Among these, sodium and potassium salts are particularly preferred. If desired, instead of the monomer HOOC-Ph-COOH, small amounts, particularly not more than 10 mol % of other acids that possess at least two carboxyl groups, based on the fraction of Ph with the above-mentioned meaning, can be comprised in the soil-release polyester. Exemplary alkylene and alkenylene dicarboxylic acids include malonic acid, succinic acid, fumaric acid, maleic acid, glutaric acid, adipic acid, pimelic acid, suberic acid, azelaic acid and sebacic acid. The preferred diols $HO—(CHR^{11}—)_aOH$ include those in which $R^{11}$ is hydrogen and a is a number from 2 to 6, and those in which a has the value 2 and $R^{11}$ is selected from hydrogen and alkyl groups with 1 to 10, particularly, 1 to 3 carbon atoms. The last named diols are particularly preferably those of the formula $HO—CH_2—CHR^{11}OH$, in which $R^{11}$ has the above-mentioned meaning. Exemplary diol components are ethylene glycol, 1,2-propylene glycol, 1,3-propylene glycol, 1,4-butane diol, 1,5-pentane diol, 1,6-hexane diol, 1,8-octane diol, 1,2-decane diol, 1,2-dodecane diol and neopentyl glycol. Polyethylene glycol with an average molecular weight of 1,000 to 6,000 is particularly preferred among the polymeric diols.

If desired, the polyesters constituted as described above can be end blocked, wherein the blocking groups can be alkyl groups with 1 to 22 carbon atoms and esters of monocarboxylic acids. The blocking groups bonded through ester linkages can be based on alkyl, alkenyl and aryl monocarboxylic acids with 5 to 32 carbon atoms, particularly 5 to 18 carbon atoms. They include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, elaiostearic acid, arachic acid, gadoleic acid, arachidonic acid, behenic acid, erucic acid, brassidic acid, clupanodonic acid, lignoceric acid, cerotic acid, melissic acid, benzoic acid that can carry 1 to 5 substituents with a total of up to 25 carbon atoms, particularly 1 to 12 carbon atoms, for example, tert.-butylbenzoic acid. The blocking groups can also be based on hydroxymonocarboxylic acids with 5 to 22 carbon atoms, examples of which include hydroxyvaleric acid, hydroxycaproic acid, ricinoleic acid, its hydrogenation product hydroxystearic acid and o-, m- and p-hydroxybenzoic acid. The hydroxymonocarboxylic acids can themselves be linked with one another through their hydroxyl group and their carboxyl group and thus be present several fold in an end group. Preferably, the number of hydroxymonocarboxylic acid units per end group, i.e., their degree of oligomerization, is in the range 1 to 50, particularly 1 to 10. In a preferred embodiment of the invention, polymers of ethylene terephthalate and polyethylene oxide terephthalate are used, in which the polyethylene glycol units have a molecular weight 750 to 5,000 and the molar ratio of ethylene terephthalate to polyethylene oxide terephthalate is 50:50 to 90:10, together with the inventively essential polymer.

The soil-release polymers are preferably water-soluble, wherein the term "water-soluble" should be understood to mean a solubility of at least 0.01 g, preferably, at least 0.1 g of the polymer per liter water at room temperature and pH 8. Under these conditions, however, preferably employed polymers exhibit a solubility of at least 1 g per liter, particularly, at least 10 g per liter.

Preferred laundry post-treatment compositions that comprise a polymer used in accordance with the invention, possess an "esterquat" as the laundry softener, i.e., a quaternized ester of carboxylic acid and amino alcohol. These are known substances that can be obtained by the pertinent methods of preparative organic chemistry. In this context, reference may be made to International Patent Application WO 91/01295, according to which triethanolamine is partially esterified with fatty acids in the presence of hypophosphorous acid, air is passed through and then quaternization is effected with dimethyl sulfate or ethylene oxide. Moreover, a process for manufacturing solid esterquats is known from German Patent DE 43 08 794, in which the quaternization of triethanolamine esters is carried out in the presence of suitable dispersants, preferably fatty alcohols. Reviews of this topic are available, for example, by R. Puchta et al. in Tens. Surf. Det. 30, 186 (1993), M. Brock in Tens. Surf. Det. 30, 394 (1993), R. Lagerman et al. in J. Am. Oil. Chem. Soc, 7_i, 97 (1994) as well as I. Shapiro in Cosm. Toil. 109, 77 (1994).

In the compositions, preferred esterquats are quaternized fatty acid triethanolamine ester salts that correspond to Formula (I), (I)

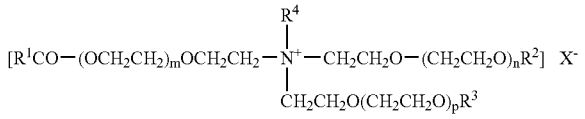

in which $R^1CO$ stands for an acyl group containing 6 to 22 carbon atoms, $R^2$ and $R^3$ independently of one another for hydrogen or $R^1CO$, $R^4$ for an alkyl group containing 1 to 4 carbon atoms or a $(CH_2CH_2O)_qH$ group, m, n, and p total 0 or stand for numbers from 1 to 12, q for numbers from 1 to 12 and X for a charge balancing anion such as halide, alkyl sulfate or alkyl phosphate. Typical exemplary esterquats that are useful in the context of the invention are products based on caproic acid, caprylic acid, capric acid, lauric acid, myristic acid, palmitic acid, isostearic acid, stearic acid, oleic acid, elaidic acid, arachic acid, behenic acid and erucic acid as well as their industrial mixtures, as for example occur from the pressure cracking of natural fats and oils. Industrial $C_{12/18}$-coco fatty acids and especially partially hardened $C_{16/18}$ tallow or palm fatty acids as well as elaidic acid-rich $C_{16/18}$ fatty acid fractions are used. For manufacturing the quaternized esters, the fatty acids and the triethanolamine are generally employed in the molar ratio 1.1:1 to 3:1. In regard to the industrial application properties of the esterquats, an addition ratio of 1.2:1 to 2.2:1, preferably, 1.5:1 to 1.9:1, has proven particularly advantageous. The preferred incorporated esterquats represent industrial mixtures of mono-, di- and triesters with an average degree of esterification of 1.5 to 1.9 and are derived from industrial $C_{16/18}$-tallow or palm fatty acid (iodine number 0 to 40). Quaternized fatty acid triethanolamine ester salts of formula (I), in which $R^1CO$ stands for an acyl group containing 16 to 18 carbon atoms, $R^2$ for $R^1CO$, $R^3$ for hydrogen, $R^4$ for a methyl group, m, n and p for 0 and X for methyl sulfate, have proved to be particularly advantageous.

Besides the quaternized carboxylic acid triethanolamine ester salts, quaternized ester salts of carboxylic acids with diethanolamines of formula (II) are suitable as esterquats, (II)

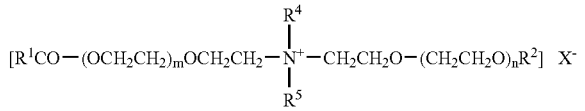

in which $R^1CO$ stands for an acyl group containing 6 to 22 carbon atoms, $R^2$ for hydrogen or $R^1CO$, $R^4$ and $R^5$ independently of one another for alkyl groups containing 1 to 4 carbon atoms, m and n total 0 or stand for numbers from 1 to 12 and X for a charge balancing anion such as halide, alkyl sulfate or alkyl phosphate.

Finally, the quaternized ester salts of carboxylic acids with 1,2-dihydroxypropyldialkylamines of formula (III) are mentioned as a further group of suitable esterquats, (III)

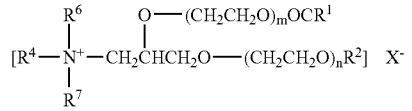

in which $R^1$ stands for an acyl group containing 6 to 22 carbon atoms, $R^2$ for hydrogen or $R^1CO$, $R^4$, $R^6$ and $R^7$ independently of one another for alkyl groups containing 1 to 4 carbon atoms, m and n total 1 or stand for numbers from 1 to 12 and X for a charge balancing anion such as halide, alkyl sulfate or alkyl phosphate.

Regarding the choice of the preferred fatty acids and the optimal degree of esterification, the exemplary statements cited for (I) are basically valid for the esterquats of formulae (II) and (III). Normally the esterquats are commercially available in the form of 50 to 90 weight percent alcoholic solutions that can be diluted with water without any problem, ethanol, propanol and isopropanol being the usual alcoholic solvents.

Esterquats are preferably used in amounts of 5 wt. % to 25 wt. %, particularly, 8 wt. % to 20 wt. %, each based on the total laundry post-treatment composition. If desired, the inventively used laundry post-treatment compositions can further comprise the above-mentioned detergent ingredients, in so far as they do not interact in an unacceptable manner with the esterquat. It is preferably a liquid, aqueous composition that is easily obtained by mixing the ingredients.

In a preferred embodiment, a composition, into which a polymer used in accordance with the invention has been incorporated, is in particulate form and comprises up to 25 wt. %, particularly, 5 wt. % to 20 wt. % bleaching agent, especially, alkali metal percarbonate, up to 15 wt. %, particularly, 1 wt. % to 10 wt. % bleach activator, 20 wt. % to 55 wt. % inorganic builder, up to 10 wt. %, particularly, 2 wt. % to 8 wt. % water-soluble organic builder, 10 wt. % to 25 wt. % synthetic anionic surfactant, 1 wt. % to 5 wt. % nonionic surfactant and up to 25 wt. %, particularly, 0.1 wt. % to 25 wt. % inorganic salts, especially, alkali metal carbonate and/or alkali metal hydrogen carbonate.

In a further preferred embodiment, a composition, into which a polymer used in accordance with the invention has been incorporated, is in liquid form and comprises 10 wt. % to 25 wt. %, particularly, 12 wt. % to 22.5 wt. % nonionic surfactant, 2 wt. % to 10 wt. %, particularly, 2.5 wt. % to 8 wt. % synthetic anionic surfactant, 3 wt. % to 15 wt. %, particularly, 4.5 wt. % to 12.5 wt. % soap, 0.5 wt. % to 5 wt. %, particularly, 1 wt. % to 4 wt. % organic builder, especially, polycarboxylate such as citrate, up to 1.5 wt. %, particularly, 0.1 wt. % to 1 wt. % complexant for heavy metals, such as phosphonate, and optionally enzyme, enzyme stabilizers, colorants and/or fragrance as well as water and/or water-miscible solvent.

Solid compositions are preferably manufactured in such a way that a particle comprising the soil-release polymer is blended with additional solid detergent ingredients. Preferably, a spray drying step is employed for manufacturing the particle that comprises soil-release polymer. Alternatively, it is also possible to employ an agglomerating compounding step for manufacturing this particle and optionally for also manufacturing the finished composition.

EXAMPLES

Preparation of a block polymer P1 (MWt: <10,000).

Styrene, methyl methacrylate and Pluriol® A 2000E were subjected to atom transfer radical polymerization.

Washing Conditions.

| | |
|---|---|
| Washing Machine: | Miele W 918 Novotronic |
| Primary Wash Performance: | Single soak process normal program |
| Wash Temperature: | 40° C. |
| Determination: | 3 times |
| Volume of Wash Liquor: | 18 l |
| Water Hardness: | 16° dH |
| Amount of Laundry: | 3.5 kg clean laundry |
| Fabric: | Cotton (1.1.10) |

Experimental.

The unsoiled fabrics were washed three times with the detergent composition (see below) with and without added polymer P1, under the above-described conditions and were dried after each wash. After the triple pre-washes, the fabrics were soiled by hand with the following stains:

0.10 g lipstick 0.10 g black shoe polish 0.10 g dust/skin waxes

The soiled fabrics were measured with a Minolta CR 200 and then aged at room temperature for 7 days. The soiled fabrics were then stapled onto towels and washed under the above-described conditions. The fabrics were dried and measured again with a Minolta CR 200.

Detergent composition [wt. %]

| | |
|---|---|
| FAEOS | 5% |
| C12/14 7 EO | 12% |
| APG | 2% |
| Fatty acids C12-18 | 5% |
| Glycerine | 5% |
| Tinopal ® CBS-X | 0.1% |
| Citrate | 1% |
| Polyacrylate | 2% |
| Protease | + |
| Amylase | + |
| Water | made up to 100% |

Washing Results [ddE-values].

| | Lipstick | black shoe polish | dust/skin waxes |
|---|---|---|---|
| Detergent without polymer P1 | 28.6 | 49.2 | 53.2 |
| Detergent + 2% polymer P1 | 37.8 | 58.5 | 57.6 |

The invention claimed is:

1. A method of washing a textile comprising contacting the textile with a cleaning composition comprising a copolymer comprising styrene, methyl methacrylate and methyl polyethylene glycol.

2. The method of claim 1 wherein the textile is a cotton textile.

3. The method of claim 1 wherein the polymer comprises from 5 to 40 mol %, styrene, from 20 to 40 mol % methyl methacrylate and from 25 to 65 mol % methyl polyethylene glycol.

4. The method of claim 1 wherein the polymer is a block copolymer.

5. The method of claim 1 further comprising a soil-release-enabling polyester of a dicarboxylic acid and diol, a polymeric diol or a mixture thereof.

6. The method of claim 1 wherein the average molar weight of the polymer is less than 10,000 D.

7. The method of claim 6 wherein the average molecular weight is from 3000 D to 8000 D.

8. A washing agent containing a soil-release-enabling copolymer comprising styrene, methyl methacrylate and methyl polyethylene glycol.

9. The washing agent of claim 8 wherein the amount of the soil-release-enabling polymer is from 0.1 wt % to 2 wt %.

10. The washing agent of claim 9 wherein the amount of the soil-release-enabling polymer is from 0.4 wt % to 1 wt %.

11. A method for manufacturing a solid washing agent comprising mixing a particle comprising the soil-release-enabling polymer comprising styrene, methyl methacrylate methyl polyethylene glycol and a solid washing-agent.

* * * * *